US007998289B2

(12) United States Patent
Brodt et al.

(10) Patent No.: US 7,998,289 B2
(45) Date of Patent: Aug. 16, 2011

(54) PRESS-HARDENED PART AND METHOD FOR THE PRODUCTION THEREOF

(75) Inventors: Martin Brodt, Weil der Stadt (DE); Uwe Fischer, Eutingen (DE); Ralf Mehrholz, Stuttgart (DE)

(73) Assignee: Daimler AG, Stuttgart (DE)

( * ) Notice: Subject to any disclaimer, the term of this patent is extended or adjusted under 35 U.S.C. 154(b) by 1601 days.

(21) Appl. No.: 10/527,721

(22) PCT Filed: Aug. 29, 2003

(86) PCT No.: PCT/EP03/09607

§ 371 (c)(1),
(2), (4) Date: Oct. 20, 2005

(87) PCT Pub. No.: WO2004/033126

PCT Pub. Date: Apr. 22, 2004

(65) Prior Publication Data

US 2006/0137779 A1 Jun. 29, 2006

(30) Foreign Application Priority Data

Sep. 13, 2002 (DE) ..... 102 42 709
Nov. 23, 2002 (DE) ..... 102 54 695

(51) Int. Cl.
*C21D 8/00* (2006.01)

(52) U.S. Cl. ..... 148/567; 148/650

(58) Field of Classification Search ..... 148/567, 148/650

See application file for complete search history.

(56) References Cited

U.S. PATENT DOCUMENTS

| | | | | |
|---|---|---|---|---|
| 5,669,992 | A | 9/1997 | Bronsema et al. | |
| 5,972,134 | A | 10/1999 | Buschsieweke et al. | |
| 6,293,134 | B1 | 9/2001 | Johnson | |
| 6,470,772 | B2 | 10/2002 | Peisert et al. | |
| 6,918,224 | B2 * | 7/2005 | Tjoelker et al. | 52/745.19 |
| 2001/0042393 | A1 | 11/2001 | Kefferstein et al. | |
| 2002/0069945 | A1 | 6/2002 | Streubel et al. | |
| 2002/0104591 | A1 | 8/2002 | Gehringhoff et al. | |
| 2004/0026562 | A1 | 2/2004 | Jacobsson et al. | |

FOREIGN PATENT DOCUMENTS

| | | |
|---|---|---|
| AT | 321 689 | 4/1975 |
| DE | 24 52 486 A1 | 5/1975 |
| DE | 198 82 558 T1 | 7/2000 |
| DE | 197 43 802 C2 | 9/2000 |

(Continued)

*Primary Examiner* — Roy King
*Assistant Examiner* — Jie Yang
(74) *Attorney, Agent, or Firm* — Patent Central LLC; Stephan A. Pendorf

(57) ABSTRACT

To produce a metallic shaped part (1), in particular a vehicle body part, from a semifinished product (2) made of an unhardened hot-workable steel sheet, first of all the semifinished product (2) is formed by a cold-forming method, in particular a drawing method, into a part blank (10) (process step II). The part blank (10) is then trimmed at the margins to a marginal contour (12') approximately corresponding to the part (1) to be produced (process step III). Finally, the trimmed part blank (17) is heated and press-hardened in a hot-forming tool (23) (process step IV). The part (1) produced in the process already has the desired marginal contour (24) after the hot forming, so that the final trimming of the part margin is dispensed with. In this way, the cycle times during the production of hardened parts of steel sheet can be considerably reduced.

12 Claims, 3 Drawing Sheets

FOREIGN PATENT DOCUMENTS

| | | | |
|---|---|---|---|
| DE | 200 14 361 | U1 | 11/2000 |
| DE | 100 32 297 | A1 | 2/2002 |
| DE | 100 49 660 | A1 | 4/2002 |
| DE | 100 55 275 | A1 | 5/2002 |
| DE | 101 49 220 | C1 | 8/2002 |
| DE | 101 49 221 | C1 | 8/2002 |
| EP | 1 052 295 | A2 | 11/2000 |
| EP | 1 143 029 | A1 | 10/2001 |

* cited by examiner

PRESS-HARDENED PART AND METHOD FOR THE PRODUCTION THEREOF

CROSS REFERENCE TO RELATED APPLICATION

This application is a national stage of PCT/EP2003/009607 filed Aug. 29, 2003 and based upon DE 102 42 709.7 filed Sep. 13, 2002 and upon DE 102 54 695.9 filed Nov. 23, 2002 under the International Convention.

BACKGROUND OF THE INVENTION

1. Field of the Invention

The invention relates to a method of producing a metallic shaped part, in particular a vehicle body part, from a semifinished product made of an unhardened hot-workable steel sheet.

2. Related Art of the Invention

Many parts, in particular body parts in vehicle construction, must satisfy stringent requirements with regard to rigidity and strength. At the same time, in the interests of weight reduction, the parts are to have as small a material thickness as possible. In order to meet these two requirements, high-strength and super-high-strength steel materials, which—depending on composition and heat treatment—have very high strength, are being increasingly used. The production of vehicle body parts from these super-high-strength steel sheets is preferably effected in a hot-forming process, in which—as described, for example, in DE 100 49 660 A1—a sheet blank is heated and then shaped in a special shaping tool and hardened. In this case, by the process parameters during the hot forming being suitably selected, the strength and toughness values of the part can be specifically set.

To produce such a part by means of hot forming, first of all a sheet blank is cut out of a coil, this sheet blank is then heated above the structural transformation temperature of the steel materials, above which the material structure is in the austenitic state, is inserted in the heated state into a forming tool and formed into the desired part shape and is cooled down while mechanically fixing the desired forming state, tempering or hardening of the part being effected.

However, in order to cut a part produced in this way in a dimensionally accurate manner, a large outlay in terms of equipment is required: in particular, very high cutting forces are required for the cold cutting of hardened materials, which leads to rapid tool wear and high maintenance costs. Furthermore, the cold trimming of such high-strength parts is problematical, since, for example, the part edges trimmed in the cold state have more or less large burrs, a factor which may lead to rapid crack formation in the part on account of the high notch sensitivity of the high-strength materials.

To avoid these difficulties which occur during the mechanical trimming of the hardened parts, alternative cutting methods are often used, such as, for example, laser cutting or water-jet cutting. High-quality trimming of the edge of the parts can certainly be achieved by means of these methods, but these cutting methods work comparatively slowly, since the cycle times here depend directly on the length of the cut edge and on the tolerances to be maintained. The final trimming process therefore produces a bottleneck during the production of hot-formed parts, which limits the number of parts to be produced per unit of time. The total cycle time of the part production can certainly be reduced if—depending on the length of the cut edge—a plurality of laser or water-jet cutting units working in parallel are provided; however, this involves high additional investment and logistics outlay and is therefore disadvantageous.

SUMMARY OF THE INVENTION

The object of the invention is therefore to improve the method sequence during the production of parts of hot-workable sheets to the effect that the cycle time—irrespective of the length of the part outer contour—can be reduced.

The object is achieved according to the invention by a method of producing a metallic shaped part from a semifinished product made of an unhardened hot workable steel sheet, comprising the following method steps:

(I) providing a semifinished product;

(II) forming a part blank (10) from the semifinished product (2) by a cold-forming method;

(III) trimming the part blank (10) at the margins to a marginal contour (12') approximately corresponding to the part (1) to be produced;

(IV) heating and press-hardening the trimmed part blank (17) in a hot-forming tool (23).

The essence of the invention consists in the idea that the part production process should be configured in such a way that the costly final trimming, which is complicated in terms of the process, of the hardened part can be dispensed with. According to the invention, therefore, the marginal regions are already cut off in the unhardened state of the part, and not only after the heating and hardening process, as is conventional practice during the hot forming.

The production process according to the invention therefore makes provision for a sheet blank to first of all be cut out from a coil of hot-workable steel sheet. A part blank is then formed from this sheet blank by means of a conventional cold-forming method, e.g. deep drawing, and subsequent trimming of the marginal regions, this part blank having both (approximately) the desired three-dimensional shape and (approximately) the desired outer contour of the finished part. This part blank is then heated to a temperature above the forming temperature of the material and is transferred in the hot state into a hot-forming tool, in which the part is press-hardened. In this method step, the part blank is formed to a comparatively small extent and is at the same time subjected to a specific heat treatment, in the course of which hardening covering the entire part or local hardening is effected.

Since the part blank already has approximately the desired dimensions at the start of the hot forming, only comparatively slight adaptation or correction of the part contour is required during the hot forming. As a result, the part margins are changed only slightly, so that there is no need for final trimming of the part margins. Here, "part margins" refer to both outer margins and inner marginal regions (margins of apertures of the part).

In contrast to conventional hot-forming methods, the trimming of excess marginal regions in the production method according to the invention is therefore effected before the hot forming; at this moment, the part blank is in a soft (unhardened) state and can therefore be trimmed by means of conventional mechanical methods. The conventional laser or water-jet trimming of the finished pressed part can therefore be dispensed with, so that the processing times can be considerably reduced compared with the conventional process sequence. At the same time, a high-quality cut edge is achieved.

Furthermore, when using the method according to the invention, the part is now formed only slightly in the hot-forming tool; the tool wear of the hot-forming tool can therefore be considerably reduced.

Since the part geometry is produced (almost) completely by cold forming, the production of the part can be validated during the design phase by conventional forming simulations. This enables development costs for part and tool to be reduced.

Particular advantages can be achieved if the cold-forming method used for shaping the part geometry to near net shape is a (multistage) deep-drawing method. Since multistage formability of the part blank is possible in the soft state, complex part geometries can also be shaped. Cutting tools are advantageously provided in the last stage of the deep-drawing tool, so that the trimming of the part blank is effected directly in the cold-forming tool.

Mechanical cutting means are preferably used for trimming the part blank. These cutting means may be integrated in the cold-forming tool in the form of edging and/or punching tools, so that the trimming of the margins is not effected in a separate method step but as part of the cold forming.

In order to be able to further reduce the cycle time of the entire process, it is advantageous to design the process step of the press hardening of the trimmed part blank to be as brief as possible in order to ensure as high a throughput of parts as possible per hot-forming tool. To this end, the finish-shaped part should be cooled down as rapidly as possible. In an advantageous embodiment, the finish-shaped part is quenched in a tool which is cooled by means of a brine (at a temperature of <0° C.) as cooling medium; such a brine has especially high thermal conductivity and thermal capacity. In this way, especially rapid cooling of the part can be achieved.

An additional reduction in the cycle time of the entire process can be achieved if the part is cooled down over a plurality of stations (correspondingly a plurality of tool sets). Thus, in a first station, the part is cooled down until the temperature drops below the martensite boundary temperature. The part strength is then already sufficient for further transport to the next station (or the next tool). In this second station (or a sequence of further stations), the part is then cooled down to hand temperature.

In an advantageous configuration, a semifinished product made of an air-hardened steel is used for producing the part. An advantage of air-hardened steels consists in the fact that, in principle, no additional cooling (e.g. by the hot-forming tool) is necessary for the quenching of the part. In this case, the part blank is shaped to net shape in the hot-forming tool and then cooled in the hot-forming tool only until sufficient thermal stability, rigidity and associated dimensional accuracy of the part are achieved. The part can then be removed from the hot-forming tool and be finally cooled in the air; the hot-forming tool is thus available for receiving a further part blank. In this way, the cycle times during the production of hardened parts can be further reduced. If the air hardening is effected under an inert gas, this results in the further advantage, in addition to this gain in time, that no scale forms on the part and thus the complicated subsequent de-scaling is dispensed with.

During such heating and heat treatment under inert gas, the part remains free of surface contaminants and can therefore be advantageously subjected to a surface coating directly following the hot forming and quenching (i.e. after cooling down to a temperature below the martensite temperature). In the course of this surface coating, in particular corrosion-inhibiting protective coatings (e.g. by galvanizing) can be applied to the surface of the part. In this case, the residual heat originating from the hot forming and remaining in the part can be directly utilized. Further heat treatment of the part by tempering can then be effected.

The heating of the trimmed part blank before the hot forming may be effected in a continuous furnace. Alternatively, the heating is carried out inductively. Such inductive heating is effected very quickly, for which reason an additional gain in the total process time can be achieved in this case. Furthermore, on account of the short heating duration, only negligible scaling of the surfaces of the part occurs during the heating, for which reason the use of inert gas can be dispensed with. The inductive heating has special advantages in those applications in which it is not the entire part but only selected regions of the part that are to be press-hardened: in this case, by suitable configuration of the inductors, only the regions to be hardened are selectively heated and then hardened in the hot-forming tool, whereas the remaining, unheated regions, although formed in the hot-forming tool, remain in the original ductility. Alternatively, or additionally, the induction heating enables the properties of the part to be set over the sheet thickness ("soft core—hard outer layer"). In this way, locally variable strength and rigidity properties can be achieved on the finished part.

For the inductive heating, a separate heating station—in a similar manner to the continuous furnace—may be provided between cutting device and hot-forming tool. In contrast to heating in the continuous furnace—in which a certain heating distance is necessary—the inductive heating requires less space, a factor which leads to cost savings. The shape and arrangement of the inductors is matched to the shape of the trimmed part blank or the regions to be heated. As an alternative to the heating in a separate heating station, the heating may also be effected in the cutting device (directly after the margin trimming) or in the hot-forming tool (directly before the hot forming). To this end, the cutting device or the forming tool is provided with internal inductors, or the part is heated by means of external, appropriately shaped inductors which are inserted after the margin trimming or before the hot forming into the opened cutting device or the opened hot-forming tool and are positioned there at the desired point of the part.

BRIEF DESCRIPTION OF THE DRAWINGS

The invention is explained in more detail below with reference to an exemplary embodiment shown in the drawings, in which:

FIG. 1 shows a method scheme of the production process according to the invention for producing a press-hardened part:

FIG. 2 shows perspective views of selected intermediate stages during the production of the part:

DETAILED DESCRIPTION OF THE INVENTION

FIGS. 1*a* to 1*e* schematically show the method according to the invention for producing a three-dimensionally shaped, press-hardened part 1 from a semifinished product 2. In the present exemplary embodiment, the semifinished product 2 used is a sheet blank 3 which is cut out of an unwound sheet coil. Alternatively, the semifinished product used may be a composite sheet which—as described, for example, in DE 100 49 660 A1—consists of a base sheet and at least one reinforcing sheet. Furthermore, the semifinished product used may be a tailored blank which consists of a plurality of welded-together sheets of different material thickness and/or different material constitution. Alternatively, the semifinished product may be a three-dimensionally shaped sheet-metal part which is produced by any desired forming method and which is to be subjected to further forming and a strength/rigidity increase by means of the method according to the invention.

The semifinished product 2 consists of a hot-workable steel. At this point, the air-hardened steel from Benteler sold under the trade designation BTR 155 may be cited as an example of such a material, this steel having the alloy composition listed below, in which case the contents of the alloy partners to be added in addition to the base metal are to be understood in percentage by weight:

carbon: 0.18-0.28%
silicon: 0.7% max.
manganese: 2.00-4.00%
phosphorous: 0.025% max.
sulfur: 0.010% max.
chromium: 0.7% max.
molybdenum: 0.55% max.
nickel: 0.6% max.
aluminum: 0.020-0.060%

Figure 1A:
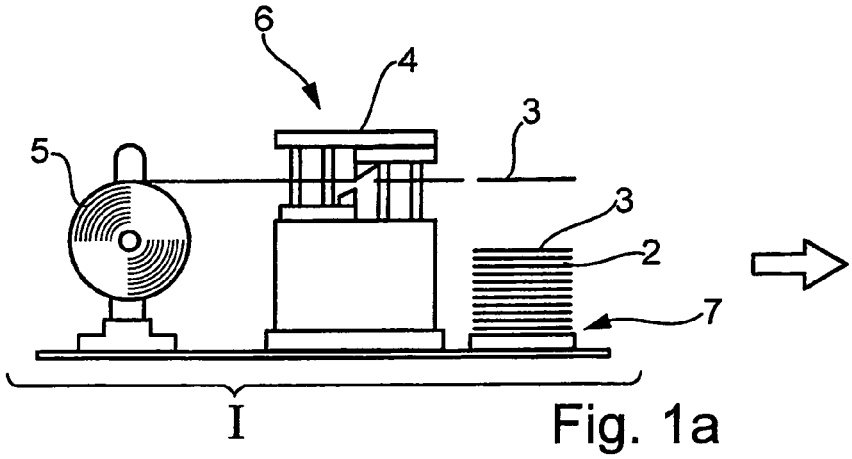
FIG. 1*a*: cutting the blank to size (step I)
Figure 2A:
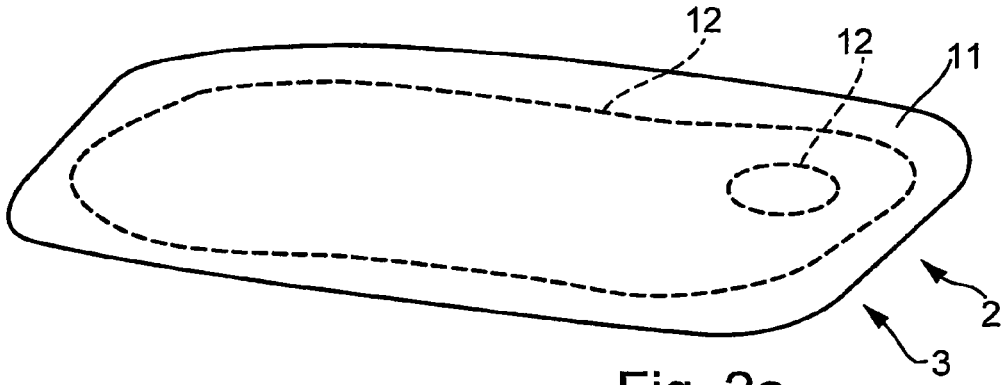
FIG. 2*a*: a semifinished product.

In a first process step I, the sheet blank 3—as shown in FIG. 1*a*—is cut out of an unwound and straightened section of a coil 5. At this point, the hot-workable material is in a "soft" (i.e. unhardened) state, so that the sheet blank 3 can be cut out without any problems by conventional mechanical cutting means—for example by means of reciprocating shears 4. In large-scale production use, the blank 3 is preferably cut to size by means of a blanking press 6, which ensures automated feeding of the coil 5 and automatic punching-out and discharge of the cut-out sheet blank 3. The sheet blank 3 cut out in this way is shown in FIG. 2*a* in a schematic perspective view.

Figure 1B:
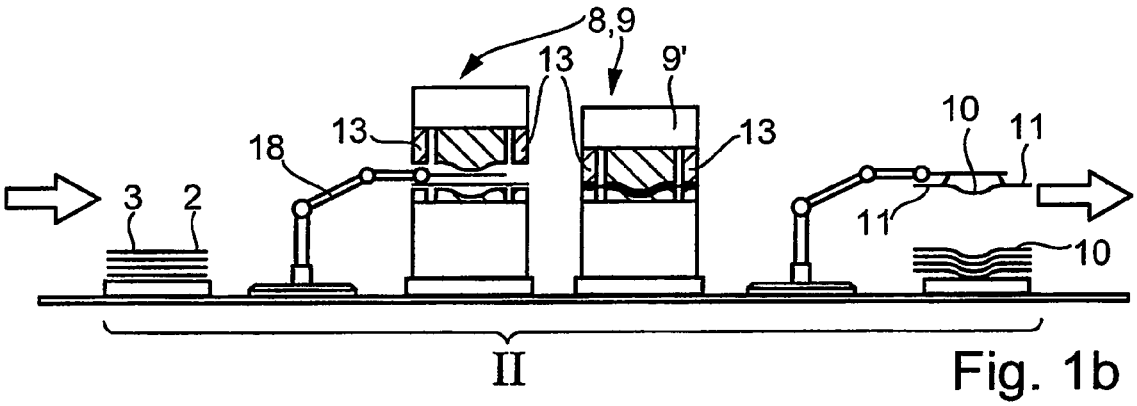
FIG. 1*b*: cold forming (step II)

The cut-out sheet blanks 3 are deposited on a stack 7 and are fed in stacked form to a cold-forming station 8 (see FIG. 1*b*). Here, in a second process step II, a part blank 10 is formed from the sheet blank 3 by means of the cold-forming tool 8—a two-stage deep-drawing tool 9 in the present example. In order to ensure high-quality shaping of the part geometry in a controlled manner, a predetermined, optimized material flow on the sheet blank 3 must be specifically ensured during the cold-forming process. In order to achieve this, the sheet blank 3 has marginal regions 11 which project beyond an outer contour 12 (indicated by broken lines in FIG. 2*a*) of the part 1 to be formed. Forces are exerted in these marginal regions 11 by hold-downs 13 during the drawing process, and these forces produce a specific material flow on the sheet blank 3 and give rise to a high-quality drawing result.

Figure 2B:
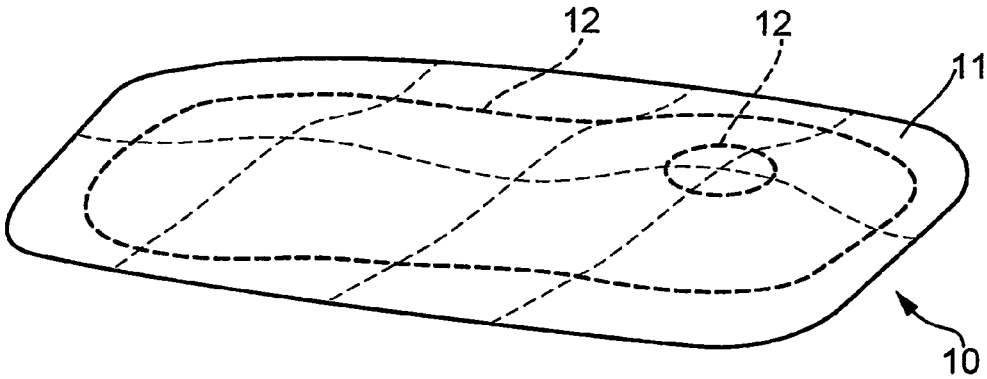
FIG. 2*b*: a part blank formed therefrom.

In the course of this cold-forming process (process step II), the part blank 10 is shaped to near net shape. In this case, "near net shape" refers to the fact that those portions of the geometry of the final part 1 which are accompanied by a macroscopic material flow are completely formed in the part blank 10 after completion of the cold-forming process. After completion of the cold-forming process (process step II), only slight adaptations of shape, which require minimum (local) material flow, are therefore necessary for producing the three-dimensional shape of the part 1; the part blank 10 is shown in FIG. 2*b*.

Depending on the complexity of the part geometry, the shaping to near net shape may be effected in a single deep-drawing step or it may be effected in a plurality of stages—for example in the two-stage deep-drawing press 9 shown in FIG. 1*b*.

Figure 1C:
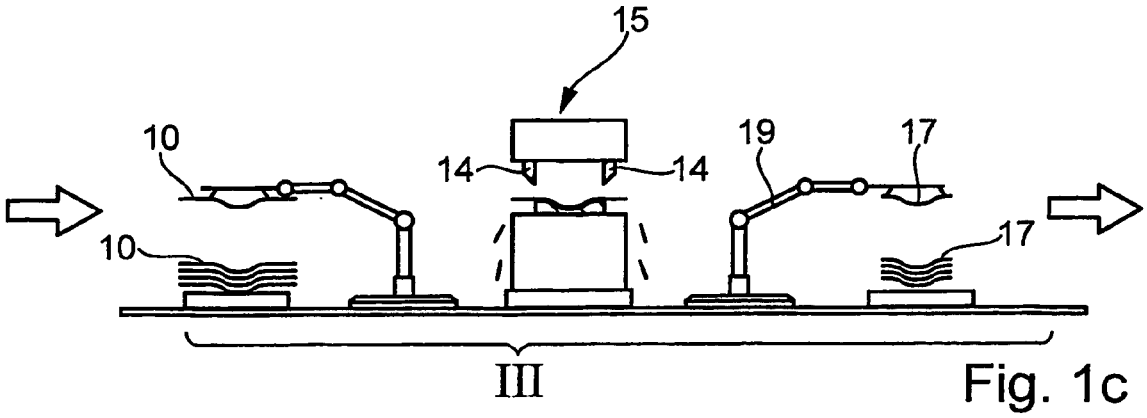
FIG. 1*c*: trimming the margins (step III)

Following the cold-forming process, the part blank 10 is inserted into a cutting device 15 and trimmed there (process step III, FIG. 1*c*). Since the material of the part blank 10 at this moment is still in a "soft", i.e. unhardened, state, this trimming process may be effected by mechanical cutting means 14 (in particular with cutting blades, edging and/or punching tools).

A separate cutting device 15—as shown in FIG. 1*c*—may be provided for the trimming operation. Alternatively, the cutting means 14 may be integrated in the last stage 9' of the deep-drawing tool 9, so that, in addition to the finish shaping of the part blank 10, the margin trimming may also be effected in the last deep-drawing stage 9'.

Figure 2C:
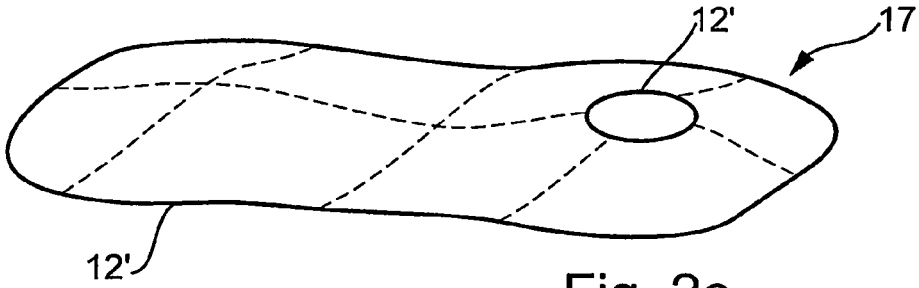
FIG. 2*c*: a trimmed part blank.
Figure 2D:
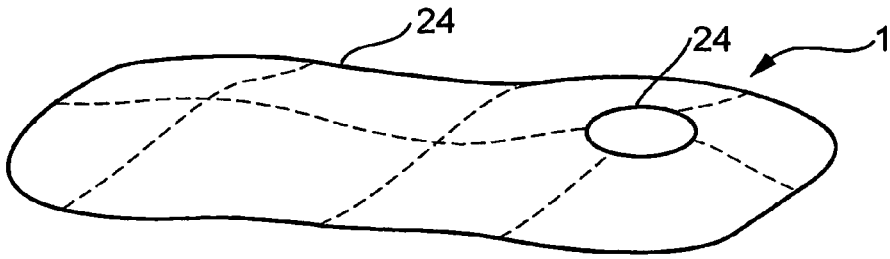
FIG. 2*d*: the finished part.

A near-net-shape trimmed part blank 17 is therefore produced from the sheet blank 3 by the cold-forming process and the trimming process (process steps II and III), this trimmed part blank 17, with regard to both its three-dimensional shape and its marginal contour 12', deviating only slightly from the desired part shape. The cut-off marginal regions 11 are discharged in the cutting device 15; the part blank 17 (FIG. 2*c*) is removed from the cutting device 15 by means of a manipulator 19 and fed to the next process step.

In the following process step IV (FIG. 1*d*), the trimmed part blank 17 is now subjected to hot forming, in the course of which it is shaped to the final part shape 1 and hardened. To this end, the trimmed part blank 17 is inserted by means of a manipulator 20 into a continuous furnace 21, where it is heated to a temperature which is above the structural transformation temperature in the austenitic state; depending on the type of steel, this corresponds to heating to a temperature of between 700° C. and 1100° C. The atmosphere of the continuous furnace 21 is advantageously rendered inert by a specific and sufficient addition of an inert gas in order to prevent scaling of uncoated intersections 12' of the trimmed blanks 17 or—when using uncoated sheets—on the entire blank surface. The inert gas used may be, for example, carbon dioxide and/or nitrogen.

The heated trimmed part blank 17 is then inserted by means of a manipulator 22 into a hot-forming tool 23, in which the three-dimensional form and the marginal contour 12' of the trimmed part blank 17 are given their final, desired size. Since the trimmed part blank 17 already has dimensions near net shape, only a slight adaptation of shape is necessary during the hot forming. In the hot-forming tool 23, the trimmed blank 17 is finish-shaped and rapidly cooled, as a result of which a fine-grained martensitic or bainitic material structure is set. This method step corresponds to hardening of the part 1 and permits specific setting of the material strength. Details and various configurations of this hardening process are described, for example, in DE 100 49 660 A1. In this case, hardening which covers the entire part 1 may be effected; alternatively, by a suitable form of the hot-forming tool (e.g. insulating inserts, air gaps, etc.), selected regions of the part 1 may be omitted from the hardening, so that the part 1 is only hardened locally.

If the desired hardening state of the part 1 has been reached, the part 1 is removed from the hot-forming tool 23. Due to the fact that the part blank 10 is trimmed to near net shape preceding the hot-forming process and on account of the adaptation of shape of the outer margin 12' in the hot-forming tool 23, the part 1 already has the desired outer contour 24 after completion of the hot-forming process, so that no time-consuming trimming of the part margin is necessary after the hot forming.

In order to achieve rapid quenching of the part 1 in the course of the hot forming, the part 1 is quenched in a hot-forming tool 23 cooled by brine. Such brine has a high thermal conductivity and thermal capacity . . . flows around . . . . Depending on the added salts, the brine can be cooled down to temperatures well below the freezing point of water.

As a rule, the hot forming of the part 1 is accompanied by scaling of the part surface, so that the part 1 has to be descaled in a further method step (process step V, FIG. 1*e*) in a dry-cleaning station 25 (for example by means of shot blasting).

The method sequence shown in FIGS. 1*a* to 1*e*, with the trimming of the part blanks 10 to near net shape in the soft state, considerably reduces the cycle time compared with the conventional method sequence, in which the finished, hardened part is not trimmed to the final size until after the hot forming by means of (laser) cutting. If the method according to the invention is used, the part 1 already has the desired final outer contour 24 after completion of the hot forming (process step IV), so that the hard trimming which formed the bottleneck in the conventional method sequence is dispensed with.

In the method sequence according to the invention, the cooling of the finish-shaped part 1 in the hot-forming tool 23 now constitutes the bottleneck of the entire method: this is because, during hardening in the tool 23, the cooling time required overall, depending on sheet thickness, workpiece size and final temperature, is about 20 to 40 seconds in a good design of the cooling integrated in the tool, most of the cases being within a range of between 25 and 30 seconds. A reduction in the cycle time can be achieved here by using air-hardened steels as materials for the parts 1: in this case, the part 1 only needs to be cooled down in the hot-forming tool 23 until sufficient thermal stability, rigidity and associated dimensional accuracy of the part 1 are achieved; the part 1 can then be removed from the tool 23, so that the further heat-treatment process may be effected in the air outside the tool 23, and the hot-forming tool 23 is available for receiving a next part blank 17. In this way, the dwell time of the part 1 in the hot-forming tool 23 can be reduced to a few (<10) seconds, which leads to a further reduction in the total cycle time.

Figure 1D:
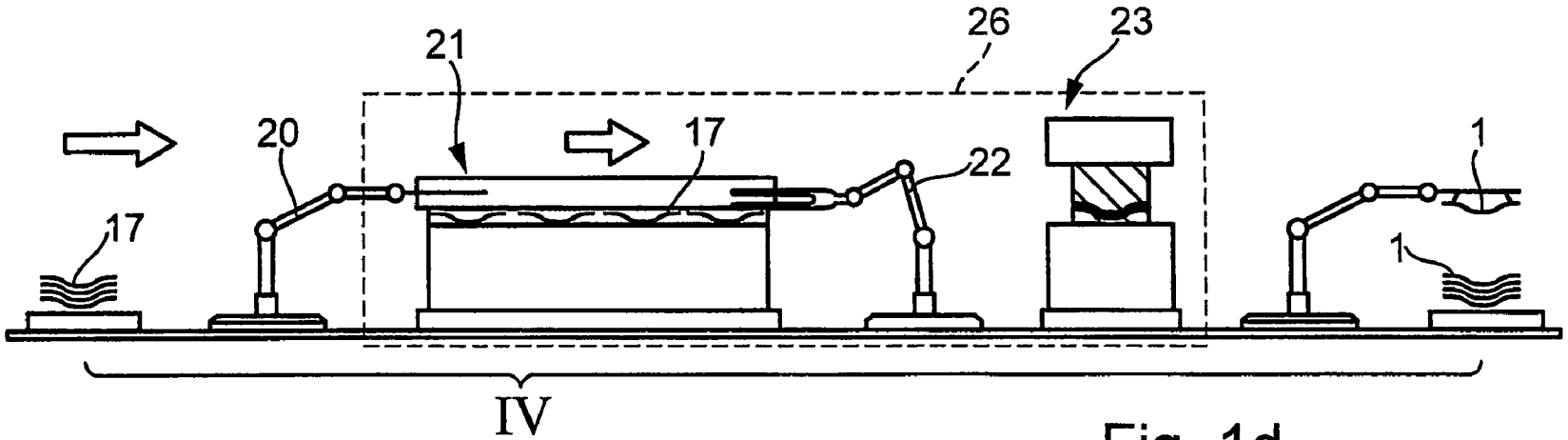
FIG. 1*d*: hot forming (step IV)
Figure 1E:
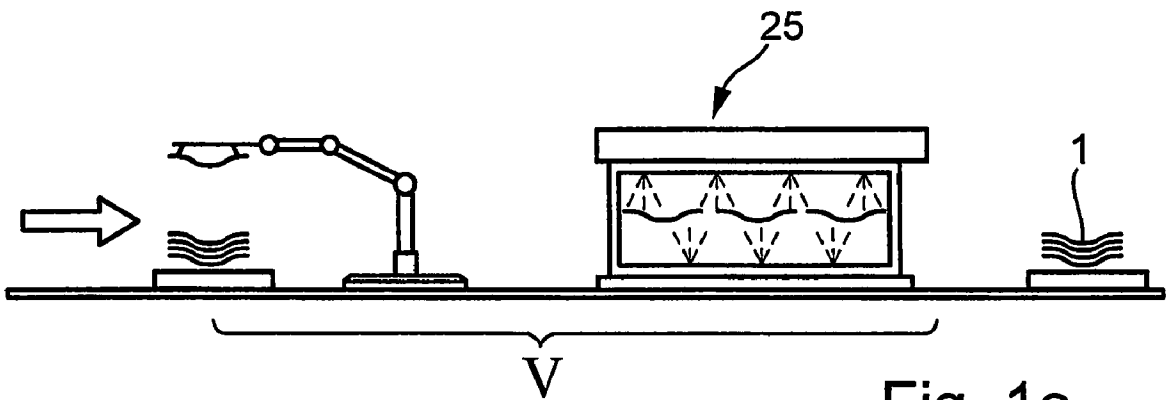
FIG. 1*e*: dry cleaning (step V)

Additional savings or reductions in the cycle time can be achieved if not only the heating of the part blanks 17 but also the hot forming is effected in an inert-gas atmosphere; in this case, the forming tool 23, as indicated by broken lines in FIG. 1*d*, is integrated in the inert-gas atmosphere 26 of the continuous furnace 21. As a result, a scale-free press-hardening process is realized, so that the subsequent dry cleaning, otherwise required previously, of the parts 1 (process step V) can be dispensed with.

As an alternative to the heating of the part blanks 17 in the continuous furnace 21, the heating may be effected inductively.

The invention claimed is:

1. A method of producing a press-hardened metallic shaped part, comprising the following method steps:

(I)—providing a sheet blank of a hot-workable steel sheet;

(II)—cold forming a part blank (10) having a three-dimensional shape and outer contour corresponding approximately to that of the finished product from the sheet blank (2);

(III)—trimming the part blank (10) at the margins to a marginal contour (12') approximately corresponding to the part (1) to be produced;

(IV)—heating and press-hardening the trimmed part blank (17) in a hot-forming tool (23); and (V)—final shaping the heated product of step (IV) and rapidly cooling the trimmed part blank (17) in a hot-forming tool (23) to set the material structure.

2. The method as claimed in claim 1, wherein a deep-drawing method is used for shaping the part blank (10) from the sheet blank (2).

3. The method as claimed in claim 1, wherein the part blank (10) is trimmed by a mechanical cutting method (15).

4. The method as claimed in claim 3, wherein the trimming of the part blank (10) is effected as part of the cold forming.

5. The method as claimed in claim 1, wherein the tool (23) is cooled with brine.

6. The method as claimed in claim 1, wherein the sheet blank (2) is made of an air-hardened steel alloy.

7. The method as claimed in claim 1, wherein the heating and hot forming of the trimmed part blank (17) are effected in an inert-gas atmosphere (26).

8. The method as claimed in claim 7, wherein (IV)—the part (1) is cooled after the hot forming down to a temperature below the martensite temperature, and is provided immediately afterward with a surface coating, in particular an anti-corrosion coating.

9. The method as claimed in claim 1, wherein the heating of the trimmed part blank (17) in process step (IV) is effected in a continuous furnace (21).

10. The method as claimed in claim 1, wherein the heating of the trimmed part blank (17) in process step (IV) is effected inductively.

11. A method according to claim 1, wherein said metallic shaped part is a motor vehicle body part.

12. A method according to claim 1, of producing a metallic shaped part, wherein said cold-forming method is a drawing method.

* * * * *